US007713094B1

(12) United States Patent
Sparrowhawk

(10) Patent No.: US 7,713,094 B1
(45) Date of Patent: May 11, 2010

(54) TELECOMMUNICATIONS CONNECTOR CONFIGURED TO REDUCE MODE CONVERSION COUPLING

(75) Inventor: Bryan L. Sparrowhawk, Monroe, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 12/425,307

(22) Filed: Apr. 16, 2009

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS 6,283,795 B1 * 9/2001 Chen ..... 439/676
6,443,776 B2 * 9/2002 Reichle ..... 439/676
7,166,000 B2 * 1/2007 Pharney ..... 439/676
7,186,148 B2 * 3/2007 Hashim ..... 439/676
7,201,618 B2 4/2007 Ellis et al.
7,204,722 B2 4/2007 Hashim et al.
7,220,149 B2 5/2007 Pharney
7,341,493 B2 * 3/2008 Pepe et al. ..... 439/676

* cited by examiner

*Primary Examiner*—Gary F. Paumen
(74) *Attorney, Agent, or Firm*—Davis Wright Tremaine LLP; George C. Rondeau, Jr.; Heather M. Colburn

(57) ABSTRACT

A communication connector including a plug and jack configured to lessen potential for crosstalk caused by unintended mode conversion coupling along wire pairs connected to tine pair 2 (tines T1 and T2) and tine pair 4 (tines T7 and T8). In the plug, twisted pair 2, connected to tine pair 2, and twisted pair 4, connected to tine pair 4, exchange lateral positions with one another thereby reducing differential voltage therebetween and unwanted transmission line mode conversion coupling. In the jack, cross-members and insulators laterally exchange longitudinal routing of the jack tine pair 2 with the jack tine pair 4 for those portions extending away from the plug engagement area of the jack. In particular, the longitudinal routing between tine T1 and tine T8 are laterally exchanged and longitudinal routing between tine T2 and tine T7 are laterally exchanged.

26 Claims, 8 Drawing Sheets

TELECOMMUNICATIONS CONNECTOR CONFIGURED TO REDUCE MODE CONVERSION COUPLING

BACKGROUND OF THE INVENTION

1. Field of the Invention

The present invention is generally related to communication connectors and their components, including telecommunications connectors.

2. Description of the Related Art

Conductors that are not physically connected to one another may nonetheless be coupled together electrically and/or magnetically. This creates an undesirable signal in the adjacent conductor referred to as crosstalk.

By placing two elongated conductors (e.g., wires) alongside each other in close proximity, a common axis can be approximated. If the opposing currents in the conductors are equal, the magnetic field 'leakage' from the conductors will decrease rapidly as the longitudinal distance along the conductors is increased. If the voltages are also opposite and equal, the electric field that is primarily concentrated between the conductors will also decrease as the longitudinal distance along the conductors is increased. This compact pair arrangement is often sufficient to avoid crosstalk if other similar pairs of conductors are in close proximity to the first pair of conductors. Twisting the pairs of conductors will tend to negate the residual field couplings and allow closer spacing of adjacent pairs. However, if for some reason the conductors within a pair are spaced far enough apart, undesired coupling and crosstalk may occur.

The structure of many conventional communication connectors is governed by standards including the RJ-45 type connector by FCC part 68 and the TIA/EIA 568 standards. Conventional telecommunications connectors typically include a communication plug and a communication jack configured to receive the plug. The jack typically provides an access point to a network, a communications device, and the like. Each of the plug and jack include a plurality of conductors or contacts. When the plug is received inside the jack, the contacts of the plug engage the corresponding tines of the jack.

The communication plug is typically physically connected to one end of a communication cable. The communication cable may be a 4-pair flexible cord, and the communication plug may be coupled thereto to create a patch cord. The cable (e.g., a patch cord) allows a communications device to communicate with the network, device, and the like connected to the jack. A convention for communication cables includes four twisted-wire pairs (also known as "twisted pairs"), which are each physically connected to the communication plug. Following this convention, a communication plug has eight contacts (P-T1 to P-T8) each connected to a different wire of the four twisted pairs (referred to as "twisted pair 1," "twisted pair 2," "twisted pair 3," and "twisted pair 4" herein). Each twisted pair serves as a differential signaling pair wherein signals are transmitted thereupon and expressed as voltage and current differences between the wires of the twisted pair. A twisted pair can be susceptible to electromagnetic sources including another nearby cable of similar construction. Signals received by the twisted pair from such electromagnetic sources external to the cable's jacket are referred to as "alien crosstalk." The twisted pair can also receive signals from one or more wires of the three other twisted pairs within the cable's jacket, which is referred to as "local crosstalk" or "internal crosstalk."

The wires of the twisted pairs 1-4 are connected to the plug contacts P-T1 to P-T8 to form four differential signaling pairs: a first plug pair 1, a second plug pair 2, a third plug pair 3, and a fourth plug pair 4. The twisted pair 2 is connected to the plug pair 2, which includes the adjacent plug contacts P-T1 and P-T2. The twisted pair 4 is connected to the plug pair 4, which includes the adjacent plug contacts P-T7 and P-T8. The twisted pair 1 is connected to the plug pair 1, which includes the adjacent plug contacts P-T4 and P-T5. The twisted pair 3 is connected to the troublesome "split" plug pair 3, which includes the plug contacts P-T3 and P-T6. The plug contacts P-T3 and P-T6 flank the plug contacts P-T4 and P-T5 of the plug pair 1. The plug pairs 2 and 4 are located furthest apart from one another and the plug pairs 1 and 3 are positioned between the plug pairs 2 and 4.

A challenge of the structural requisites of conventional communication cabling standards relates to the fact that the two wires of twisted pair 3 are connected to widely spaced contacts P-T3 and P-T6 of the communication plug which straddle contacts P-T4 and P-T5 to which two wires of the twisted pair 1 are connected, while the wires of the twisted pair 2 are connected to contacts P-T1 and P-T2 and the wires of the twisted pair 4 are connected to contacts P-T7 and P-T8. This places the twisted pair 2 and the twisted pair 4 on either side of the twisted pair 3. This arrangement can cause the signal transmitted on twisted pair 3 to impart different voltages and/or currents onto twisted pair 2 and twisted pair 4 effectively causing differential voltages between the composite of both wires of twisted pair 2 and the composite of both wires of the twisted pair 4 as an undesired cable mode conversion coupling that unfortunately may enhance alien crosstalk elsewhere that is referred to hereafter as a "modal launch" or "mode conversion."

Within the communication jack of the communication connector, the jack tines are positioned in an arrangement corresponding to the arrangement of the plug contacts P-T1 to P-T8 in the conventional communication plug. Likewise, the conventional communication cabling standards establish four differential signaling pairs: jack tine pair 2, which includes adjacent communication jack tines J-T1 and J-T2; jack tine pair 4, which includes adjacent communication jack tines J-T7 and J-T8, jack tine pair 1, which includes adjacent communication jack tines J-T4 and J-T5; and a troublesome "split" jack tine pair 3, which includes communication jack tines J-T3 and J-T6. The jack tines J-T3 and J-T6 of the jack tine pair 3 flank the jack tines J-T4 and J-T5 of the jack tine pair 1. Further, the jack tine pairs 2 and 4 are located furthest apart from one another and the jack tine pairs 1 and 3 are positioned between the jack tine pairs 2 and 4.

The "split" jack tine pair 3, with the relatively wide spacing of its jack tine J-T3 with respect to its jack tine J-T6, is especially problematic.

For illustrative purposes, the differential signal carried by the wires and associated fields of the twisted pair 3 through a conventional communication connector will now be described. First, the differential signal is associated with the wires of the twisted pair 3 into the communication plug. Within the communication plug, the wires of the twisted pair 3 are untwisted and spaced apart to connect to the split plug contacts P-T3 and P-T6. The differential signal is conducted by the split plug pair 3 to the split jack tines J-T3 and J-T6. Within the communication jack, the jack tines J-T3 and J-T6 extend inwardly toward one another to place themselves in close proximity to one another. Conductors (e.g., wires) may be connected to the jack tines J-T1 to J-T8 to carry the signal from the communication jack to a destination (e.g., a network, a device, a cable, and the like). The wires connected to the jack tines J-T3 and J-T6 of the jack tine pair 3 may be twisted together to form a twisted pair to further reduce unwanted crosstalk.

In the conventional communication connector, the mode of coupling of present concern is where the wires of twisted pair 3 are split apart within the plug (as the positions of P-T3 and P-T6 are approached) and/or the jack (J-T3 and J-T6). This splitting of wires of twisted pair 3 creates selective capacitive coupling from the two opposing signals on twisted pair 3 and increases the aperture defined by the area between the wires of pair 3 thus causing an increase of magnetic coupling between twisted pair 3 and the composite sets of wires comprising twisted pair 2 and twisted pair 4 where twisted pair 2 is treated as a two-stranded or "composite" wire as is twisted pair 4. As a result, a small "coupled" portion of the differential signal originating on twisted pair 3 appears as two opposite common, or "even," mode signals on the two-wire composites of twisted pair 2 and twisted pair 4.

Thus, where the two-wire composites of twisted pair 2 and twisted pair 4 are treated equally, the signal transmitted on twisted pair 3 may impart opposite voltages and/or currents onto twisted pair 2 and twisted pair 4, respectively, which causes differential voltages between the composite of the two wires of twisted pair 2 and the composite of the two wires of twisted pair 4. This is the coupling, and thus a "launch," of an undesired cable mode conversion that may increase undesired alien crosstalk elsewhere along the transmission path comprised of the plug, the jack and their respective cables.

This transmission path of the plug, the jack and their respective cables can thus be viewed as comprised of a plug in which some of the conductors are located in close proximity to one another and others are spaced farther apart, the interface between a portion of the plug and a portion of the jack and typically the site of origin of undesired mode conversion coupling, and the jack wherein conductors are located in close proximity to one another. This conventional arrangement of the transmission path may cause a "modal launch" that extends from the communication connector into the communication cable connected to the plug and/or the destination connected to the jack.

Within the communication jack, the modal launch effectively treats the jack tine pair 2 (i.e., jack tines J-T1 and J-T2) as a single two-stranded "paired" conductor PC-J1 that is distantly juxtaposed with the jack tine pair 4 (i.e., jack tines J-T7 and J-T8) as its opposite single two-stranded "paired" conductor PC-J2. In other words, the jack tines J-T1 and J-T2 of the jack tine pair 2 combine to form the first single "paired" conductor PC-J1 and the jack tines J-T7 and J-T8 connected to the jack tine pair 4 combine to form the second single "paired" conductor PC-J2. As a result, a "composite" differential pair is created inside the communication jack by the wider spaced apart first and second 'paired' conductors PC-J1 and PC-J2. The wider spacing of first and second 'paired' conductors PC-J1 and PC-J2 will unfortunately enhance vulnerability and sourcing of unwanted crosstalk among other cables situated in the vicinity, such as in a same cable tray, conduit, etc.

As noted, within the communication plug, the modal launch effectively treats the twisted pair 2 as a single two-stranded "paired" conductor PC-P1 that is distantly juxtaposed with the twisted pair 4 as its opposite single two-stranded "paired" conductor PC-P2. Again, the wires of the twisted pair 2 combine to form the first single "paired" conductor PC-P1 and the wires of the twisted pair 4 combine to form the second single "paired" conductor PC-P2. As a result, a "composite" differential pair is created in a communication cable by the wider spaced apart first and second 'paired' conductors PC-P1 and PC-P2. The wider spacing of the first and second 'paired' conductors PC-P1 and PC-P2 will unfortunately enhance vulnerability and sourcing of unwanted crosstalk among other cables situated in the vicinity, such as in a same cable tray, conduit, etc.

Within the plug-jack interface, the typical site of origin of undesired mode conversion coupling, of the communication connector, where the conductors (e.g., the wires of the twisted pair 3, the plug contacts P-T3 and P-T6, and the jack tines J-T3 and J-T6) are spaced apart from one another, the spaced apart conductors may couple (capacitively and/or inductively) with the other conductors of the communication connector. For example, within this plug-jack interface portion of the communication jack, the jack tine J-T3 is adjacent the first paired conductor PC-J1 and the jack tine J-T6 is adjacent the second paired conductor PC-J2. In the plug-jack interface portion of the communication jack, the jack tine J-T3 is capacitively coupled to the first paired conductor PC-J1 and the jack tine J-T6 is capacitively coupled to the second paired conductor PC-J2. A magnetic field forms between the split jack tines J-T3 and J-T6 that induces inductive coupling between split tines and the first and second paired conductors PC-J1 and PC-J2. Within the plug-jack interface portion of the communication plug, a similar result occurs.

A conventional approach to addressing this capacitive and inductive coupling is to cross the split conductors in the plug-jack interface, ideally at a location near a midpoint of the plug-jack interface from which mode conversion coupling occurs. For example, the split conductors may be crossed within the communication jack, the communication plug, or both.

If the split conductors are crossed inside the communication jack, a first portion of the jack tine J-T3 is adjacent the first paired conductor PC-J1 and a second portion of the jack tine J-T3 is adjacent the second paired conductor PC-J2. Likewise, a first portion of the jack tine J-T6 is adjacent the second paired conductor PC-J2 and a second portion of the jack tine J-T6 is adjacent the first paired conductor PC-J1. In other words, any charge in the jack tines J-T3 and J-T6 is adjacent to a portion of each of the first and second paired conductors PC-J1 and PC-J2, thereby substantially negating the effect of the capacitive coupling between the split jack tines and the first and second paired conductors PC-J1 and PC-J2.

Further, by crossing the jack tines J-T3 and J-T6, the direction of the magnetic field formed between the first portions of the jack tines is opposite that of the magnetic field formed between the second portions, which substantially negates the inductive coupling between the split jack tines and the first and second paired conductors PC-J1 and PC-J2. In other words, mode conversion coupling is reduced by removing or subtracting away an equal amount of adverse coupling from each of the first and second paired conductors PC-J1 and PC-J2. A similar result may be obtained by crossing the jack tines J-T3 and J-T6 within the plug-jack interface portion of the communication plug.

Thus, a need exists for communication plugs and communication jacks configured to reduce cross-talk. A further need exists for a communication connector configured to reduce cross-talk caused by unwanted inter-modal coupling between the conducting elements of the connector. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 1:
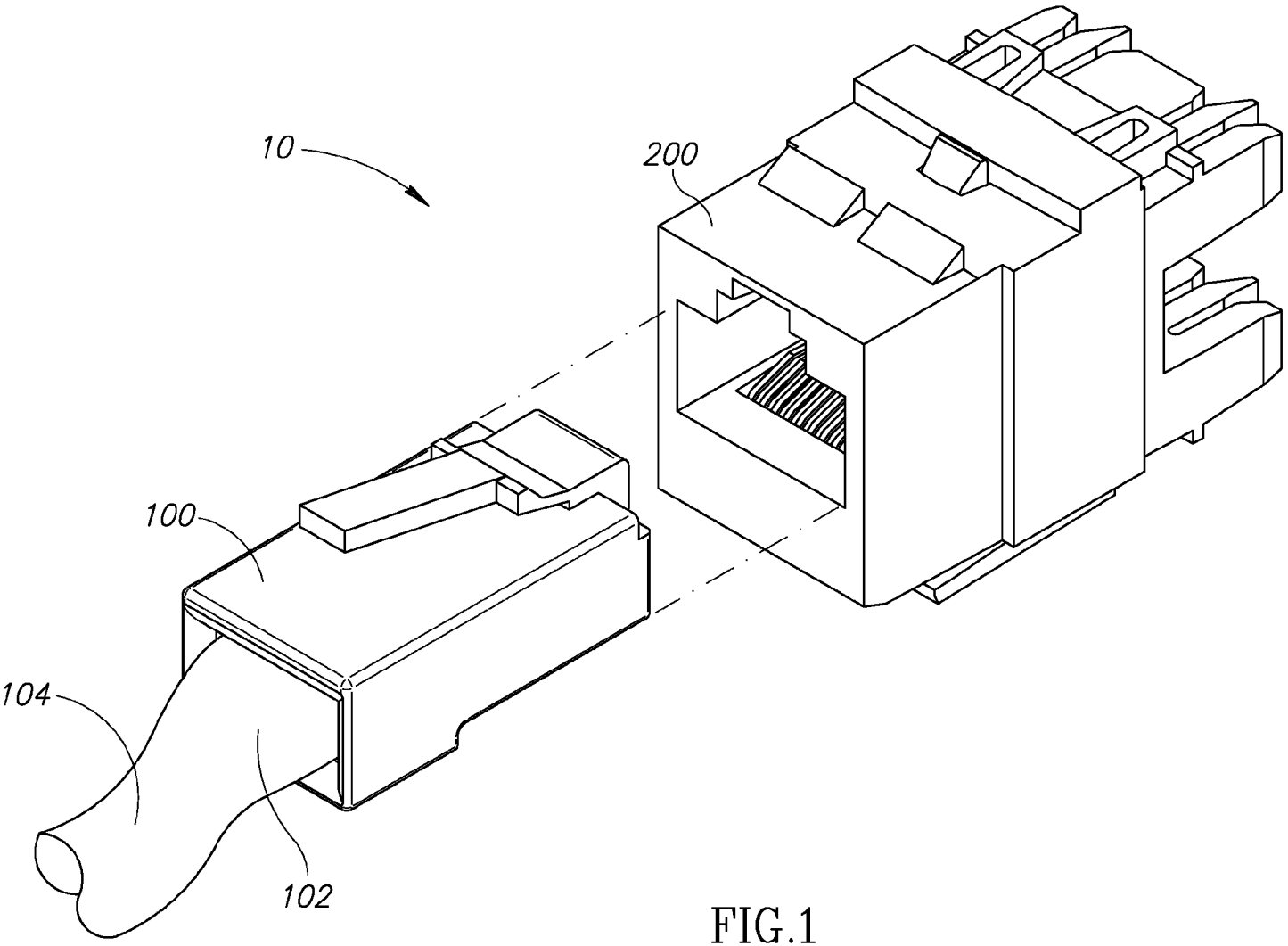
FIG. 1 is a perspective view of an embodiment of a telecommunications connector.

Referring to FIG. 1, aspects of the present invention relate to a telecommunications connector 10. The connector 10 includes a communication plug 100 connected to one end 102 of a communication cable 104 and a communication jack 200 connected to communication cabling (not shown) via a plurality of wire termination contacts (e.g., insulation displacement connectors IDC1-IDC8 shown in FIG. 5). While the wire termination contacts have been illustrated as insulation displacement connectors IDC1-IDC8, any other means of electrically coupling jack tines to electrically conductive elements in cable may be used. In addition to transmitting communication signals across the telecommunications connector 10, power may be transmitted across the telecommunications connector 10.

Communication Plug 100

Figure 2:
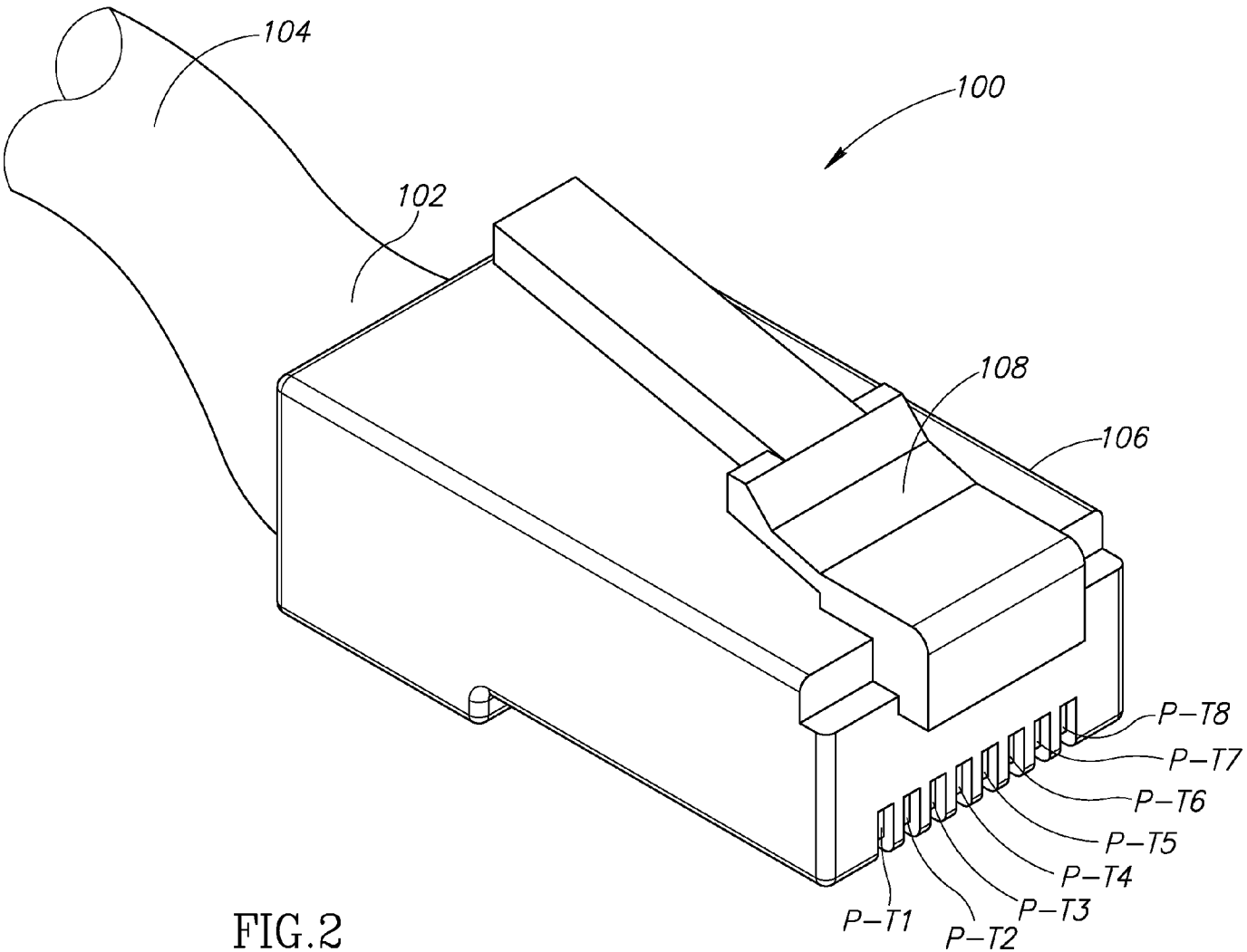
FIG. 2 is a perspective view of a communication plug of the telecommunications connector of FIG. 1.

Referring to FIG. 2, the communication plug 100 includes multiple conductors arranged in twisted pairs to lessen the potential for alien crosstalk from differential voltages that would otherwise exist. In implementations, the twisted pairs 2 and 4 exchange lateral positions with one another near to where they are physically connected to their respective conductors of the communication plug 100 to thereby create a positional exchange or macro-level twist between the twisted pair 2 and the twisted pair 4 about split pair 3 to negate any even mode signals that otherwise would appear on them and cause alien crosstalk elsewhere due to their wide separation in the cable.

Referring to FIG. 2, the communication plug 100 is depicted connected to the communication cable 104, which in the depicted implementation of the communication cable includes four twisted pairs. The communication plug 100 includes a plug body 106 with a row of eight plug contacts P-T1 to P-T8, as conductors, shown in FIG. 2 for exemplary purposes as demarcated in a left to right order for engagement with corresponding tines of the communication jack 200 (see FIG. 1). The communication plug 100 is further depicted as having an engagement latch 108 to secure the communication plug with the communication jack 200.

Figure 3:
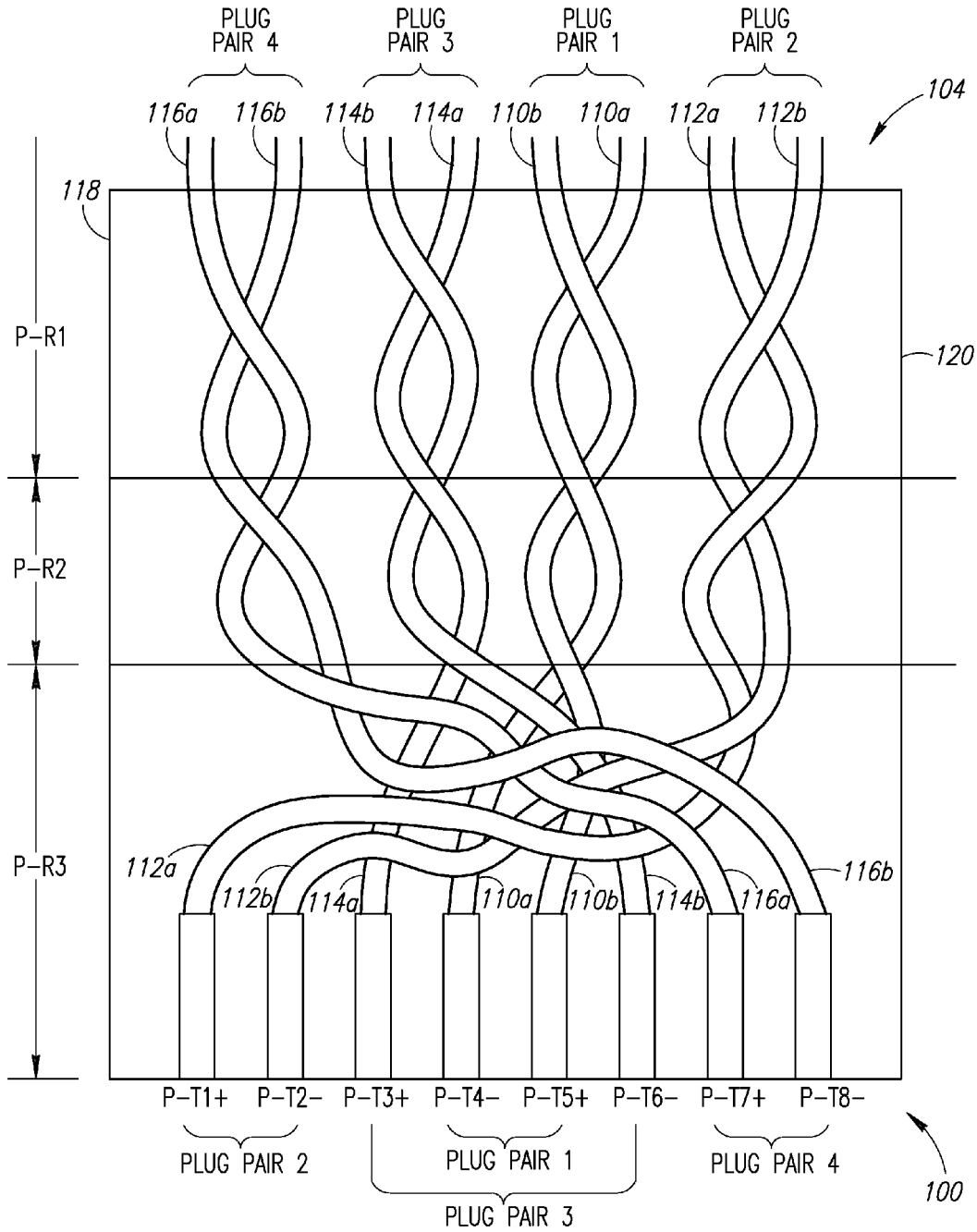
FIG. 3 is a schematic of a first wire layout for use with the communication plug of FIG. 2 depicting portions of four twisted pairs connected with the communication plug and extending therefrom.
Figure 4:
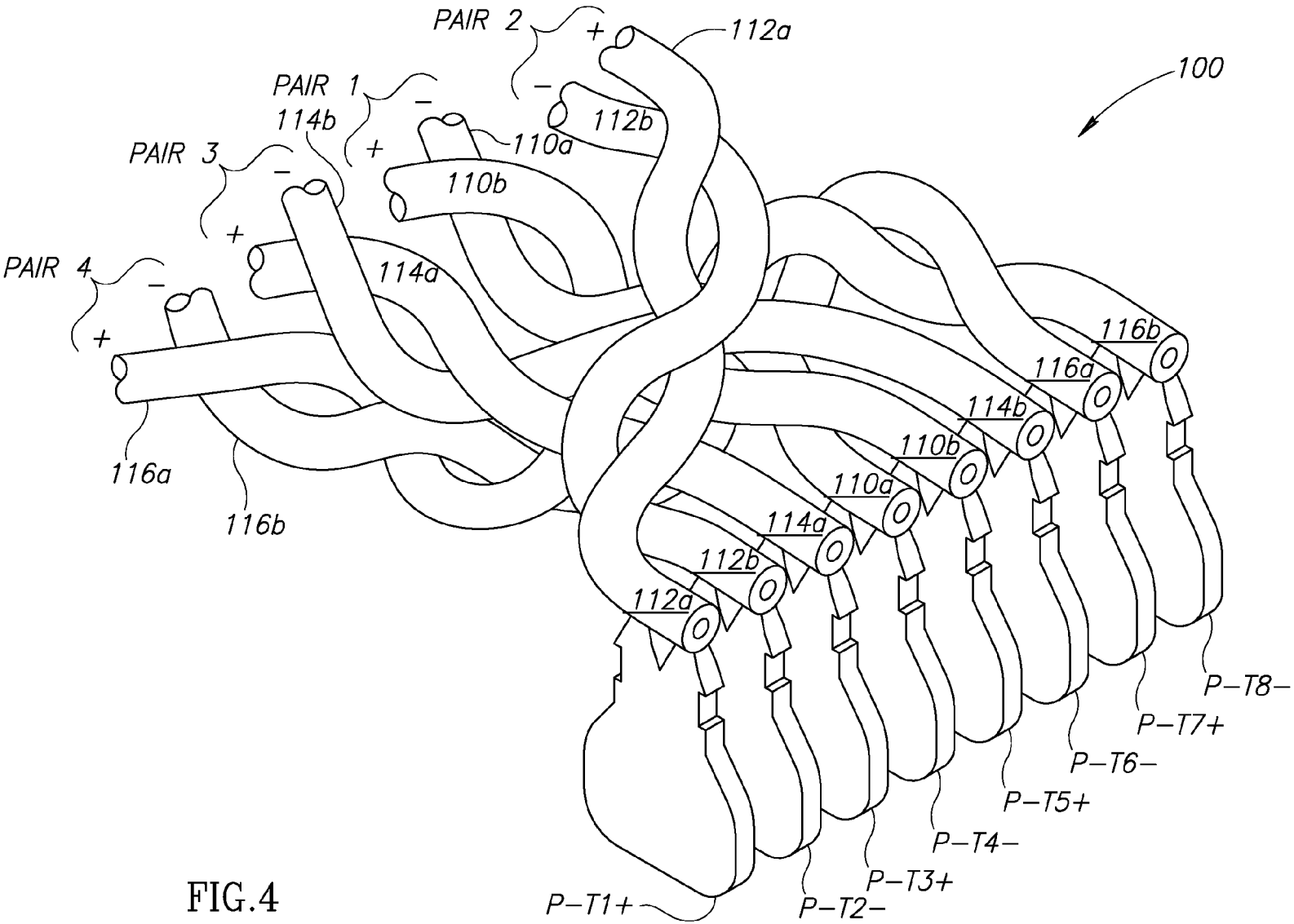
FIG. 4 is a perspective view of portions of the four twisted pairs as connected to the communication plug corresponding to the first wire layout of FIG. 3.

FIGS. 3 and 4 illustrate a first embodiment of a routing pattern used to route the four twisted pairs of the communication cable 104 from the cable to the plug contacts P-T1 to P-T8. For illustrative purposes, the routing pattern will be described with respect to three regions, a first region P-R1, a second region P-R2, and a third region or crosstalk coupling zone P-R3, as shown in FIG. 3. The crosstalk coupling zone P-R3 is closest to and includes the plug contacts P-T1 to P-T8 of the plug body 106, and extends within the communication plug 100. The second region P-R2 is directly adjacent to the crosstalk coupling zone P-R3 and extends within the communication plug 100 for a relatively short distance away therefrom. The first region P-R1 is directly adjacent to the second region P-R2 and typically extends therefrom for a majority of the length of the communication cable 104.

As depicted, the communication cable 104 includes four twisted pairs: a first plug pair 1 having a first wire 110*a* and a second wire 110*b*, a second plug pair 2 having a first wire 112*a* and a second wire 112*b*, a third plug pair 3 having a first wire 114*a* and a second wire 114*b*, and a fourth plug pair 4 having a first wire 116*a* and a second wire 116*b*. In other implementations, the communication cable 104 may include a different number of twisted pairs. The first wire 110*a* and the second wire 110*b* form a first differential signaling pair 110. The first wire 112*a* and the second wire 112*b* form a second differential signaling pair 112. The first wire 114*a* and the second wire 114*b* form a third differential signaling pair 114. The first wire 116*a* and the second wire 116*b* form a fourth differential signaling pair 116.

The communication plug 100 and the communication cable 104 are further demarcated as having a first side 118, which is closest to the plug contacts P-T1 and P-T2 in the crosstalk coupling zone P-R3, and a second side 120, which is closest to the plug contacts P-T7 and P-T8 in the crosstalk coupling zone P-R3. Some implementations of the communication cable 104 can have a round or otherwise curvilinear cross-section so that the first side 118 and the second side 120 will not physically be flat, but will still be positioned relative to the plug contacts P-T7/P-T8 and P-T1/P-T2 as shown.

In the first and second regions P-R1 and P-R2, the four twisted pairs run longitudinally with the first side 118 and the second side 120 of the communication cable 104 and are located therebetween without any cross-over. In the first and second regions P-R1 and P-R2, the fourth plug pair 4 is positioned closest to the first side 118 and the second plug pair 2 is positioned closest to the second side 120. The third plug pair 3 is shown in FIG. 3 as positioned between the fourth plug pair 4 and the first plug pair 1, whereas the first plug pair 1 is shown to be positioned between the third plug pair 3 and the second plug pair 2.

In the crosstalk coupling zone P-R3 within the communication plug 100, engagement of the wires of the twisted pairs with the contacts P-T1 to P-T8 of the communication plug occurs. As shown in FIG. 3, the first wire 110*a* and the second wire 110*b* of the first plug pair 1 are connected to contacts P-T4 and P-T5, respectively. The first wire 112*a* and the second wire 112*b* of the second plug pair 2 are connected to contacts P-T1 and P-T2, respectively. The first wire 114*a* and the second wire 114*b* of the third plug pair 3 are connected to contacts P-T3 and P-T6, respectively, on either side of the first plug pair 1. The first wire 116*a* and the second wire 116*b* of the fourth plug pair 4 are connected to contacts P-T7 and P-T8, respectively.

As shown in FIG. 3, in a portion of the third region P-R3 within the communication plug 100, the first wire 114*a* and the second wire 114*b* of the third plug pair 3 are no longer twisted together, but rather are separated apart from their twisted pair arrangement to straddle either side of the first plug pair 1. In the third region P-R3, the second plug pair 2 crosses the first plug pair 1 and the third plug pair 3 to transition from being closest to the first side 118 to being closest to the second side 120 as found in the first and second regions P-R1 and P-R2. In the third region P-R3, the fourth plug pair 4 crosses the first plug pair 1 and the third plug pair 3 to transition from being closest to the second side 120 to being closest to the first side 118 as found in the first and second regions P-R1 and P-R2. As shown, the second plug pair 2 and the fourth plug pair 4 transition in the third region P-R3 so that they cross each other. This crossing or reversing of the second plug pair 2 and the fourth plug pair 4 with respect to one another is understood to consequently help negate possible undesirable coupling between the second plug pair 2 and the fourth plug pair 4 due to differential voltage between the second plug pair 2 and the fourth plug pair 4 being imparted by the third plug pair 3 straddling the first plug pair 1.

As explained in the Background Section, in a conventional prior art communication plug, within the crosstalk coupling zone, the wires coupled to the second plug pair combine to form the first paired conductor PC-P1 and the wires coupled to the fourth plug pair combine to form the second paired conductor PC-P2. To reduce crosstalk, the first wire of the split third plug pair (which starts out near the second plug pair) is crossed over the second wire of the split third plug pair (and the wires of the first plug pair) to place the first wire in close proximity with the fourth plug pair. Additionally, the second wire of the split third plug pair (which starts out near the fourth plug pair) is crossed over the first wire of the split third plug pair (and the wires of the first plug pair) to place the second wire in close proximity with the second plug pair. The first and second paired conductors PC-P1 and PC-P2 are not crossed with any of the wires of any of the other plug pairs.

As explained above, in a conventional communication plug, crossing the first and second wires of the split third plug pair relative to the first and second paired conductors PC-P1 and PC-P2 negates both capacitive and inductive coupling between the first and second wires of the split third plug pair and the first and second paired conductors PC-P1 and PC-P2.

In contrast, in crosstalk coupling zone P-R3 of the communication plug 100, capacitive and/or inductive coupling between the first and second wires 114*a* and 114*b* of the split third plug pair 3 and the second and fourth differential signaling pairs 112 and 116 is avoided by crossing the second differential signaling pair 112 and the fourth differential signaling pair 116 instead of the first and second wires 114*a* and 114*b*. In this arrangement, any charge present in the first wire 114*a* may possibly couple with a first portion of the second differential signaling pair 112 and any charge present in the second wire 114*b* may possibly couple with a first portion of the fourth differential signaling pair 116. The first portion of the second differential signaling pair 112 is spaced apart from and juxtaposed with the first portion of the fourth differential signaling pair 116. Further, any charge present in the first wire 114*a* may possibly couple with a second portion of the fourth differential signaling pair 116 and any charge present in the second wire 114*b* may possibly couple with a second portion of the second differential signaling pair 112. The second portion of the second differential signaling pair 112 is spaced apart from, and juxtaposed with, the second portion of the fourth differential signaling pair 116.

The first portion of the second differential signaling pair 112 and the second portion of the fourth differential signaling pair 116 are both adjacent to different sections of the first wire 114*a*, which negates or cancels any capacitive coupling between the first wire 114*a* and the second and fourth differential signaling pairs 112 and 116. Similarly, the second portion of the second differential signaling pair 112 and the first portion of the fourth differential signaling pair 116 are both adjacent to different sections of the second wire 114*b*, which negates or cancels any capacitive coupling between the second wire 114*b* and the second and fourth differential signaling pairs 112 and 116. Further, the direction of the magnetic field formed between the first portions of the differential signaling pairs 112 and 116 is opposite that of the magnetic field formed between the second portions of the differential signaling pairs 112 and 116, which negates or cancels the inductive coupling between the first and second wires 114*a* and 114*b* and the second and fourth differential signaling pairs 112 and 116. In other words, in the communication plug 100, mode conversion coupling is reduced by removing or subtracting away an equal amount of adverse coupling from each of the second and fourth differential signaling pairs 112 and 116.

Communication Jack 200

Figure 5:
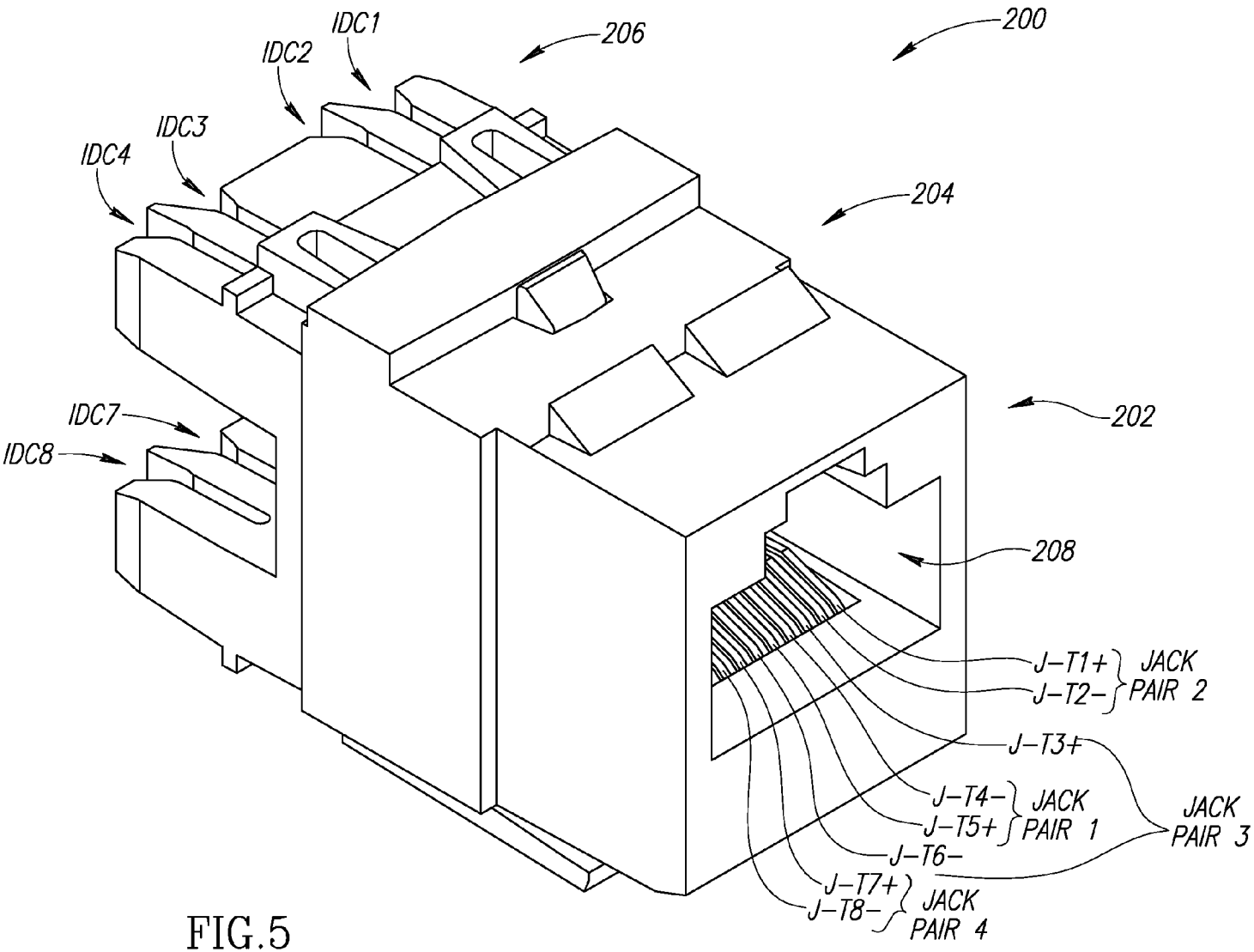
FIG. 5 is a perspective view of a communication jack of the telecommunications connector of FIG. 1.

Referring to FIG. 5, like the communication plug 100, the communication jack 200 includes eight contacts or tines J-T1 to J-T8 arranged into four tine pairs. A first pair of jack tines includes tines J-T4 and J-T5. A second pair of jack tines includes tines J-T1 and J-T2. A third pair of jack tines includes tines J-T3 and J-T6. A fourth pair of jack tines includes tines J-T7 and J-T8.

Also like the communication plug 100, the communication jack 200 includes tine arrangements to lessen potential for crosstalk due to unintended mode conversion coupling along wire pairs connected to both the second pair of jack tines J-T1 and J-T2 and the fourth pair of jack tines J-T7 and J-T8. Cross-members and insulators are used to laterally exchange longitudinal routing of the second pair of jack tines J-T1 and J-T2 with the fourth pair of jack tines J-T7 and J-T8 for those portions extending away from, but not including, the plug engagement area of the communication jack 200. In particular, the longitudinal routing between the jack tine J-T1 and the jack tine J-T8 are laterally exchanged and longitudinal routing between the jack tine J-T2 and the jack tine J-T7 are laterally exchanged.

As illustrated schematically in FIG. 8, and as will be described in greater detail below, the jack tine J-T1 extends along and near to a first longitudinal side of the communication jack 200 in the plug engagement area and then, via a lateral transition by a cross-member, extends along and near to a second longitudinal side of the communication jack opposite the first longitudinal side as it extends farther away from the engagement area. The jack tine J-T8 extends along and near to the second longitudinal side of the communication jack in the engagement area and then, via a lateral transition by a cross-member, extends along and near to the first longitudinal side of the communication jack as it extends farther away from the engagement area.

The jack tine J-T2 extends along and near to the first longitudinal side of the communication jack 200 in the engagement area and then, via a lateral transition by a cross-member, extends along and near to the second longitudinal side of the communication jack as it extends farther away from the engagement area. The jack tine J-T7 extends along and near to the second longitudinal side of the communication jack in the engagement area and then, via a lateral transition by a cross-member, extends along and near to the first longitudinal side of the communication jack as it extends farther away from the engagement area. In other words, the jack tine J-T1 and the jack tine J-T8 remain on the outward most lateral positions after their lateral exchanges and the jack tine J-T2, and the jack tine J-T7 remain in inward lateral positions relative to the jack tine J-T1 and the jack tine J-T8, respectively, to properly counter coupling related to their nearness to the third pair of jack tines J-T3 and J-T6. By swapping the locations of the second pair of jack tines J-T1 and J-T2 with the fourth pair of jack tines J-T7 and J-T8, both capacitive and inductive couplings for the second pair of jack tines and the fourth pair of jack tines are brought near to being equalized.

FIG. 5 depicts the communication jack 200 as having a jack frame 202 connected to a main housing 204 and further connected to a terminal housing 206. The jack frame 202 includes an aperture 208 to provide access to the jack tines J-T1 to J-T8 for engagement with the plug contacts P-T1 to P-T8, respectively, of the communication plug 100 (see FIGS. 1 and 2) upon insertion of the communication plug into the aperture. The terminal housing 206 includes a plurality of insulation displacement connectors IDC1-IDC8 for connecting the jack tines J-T1 to J-T8 with communication cabling (not shown).

Figure 6:
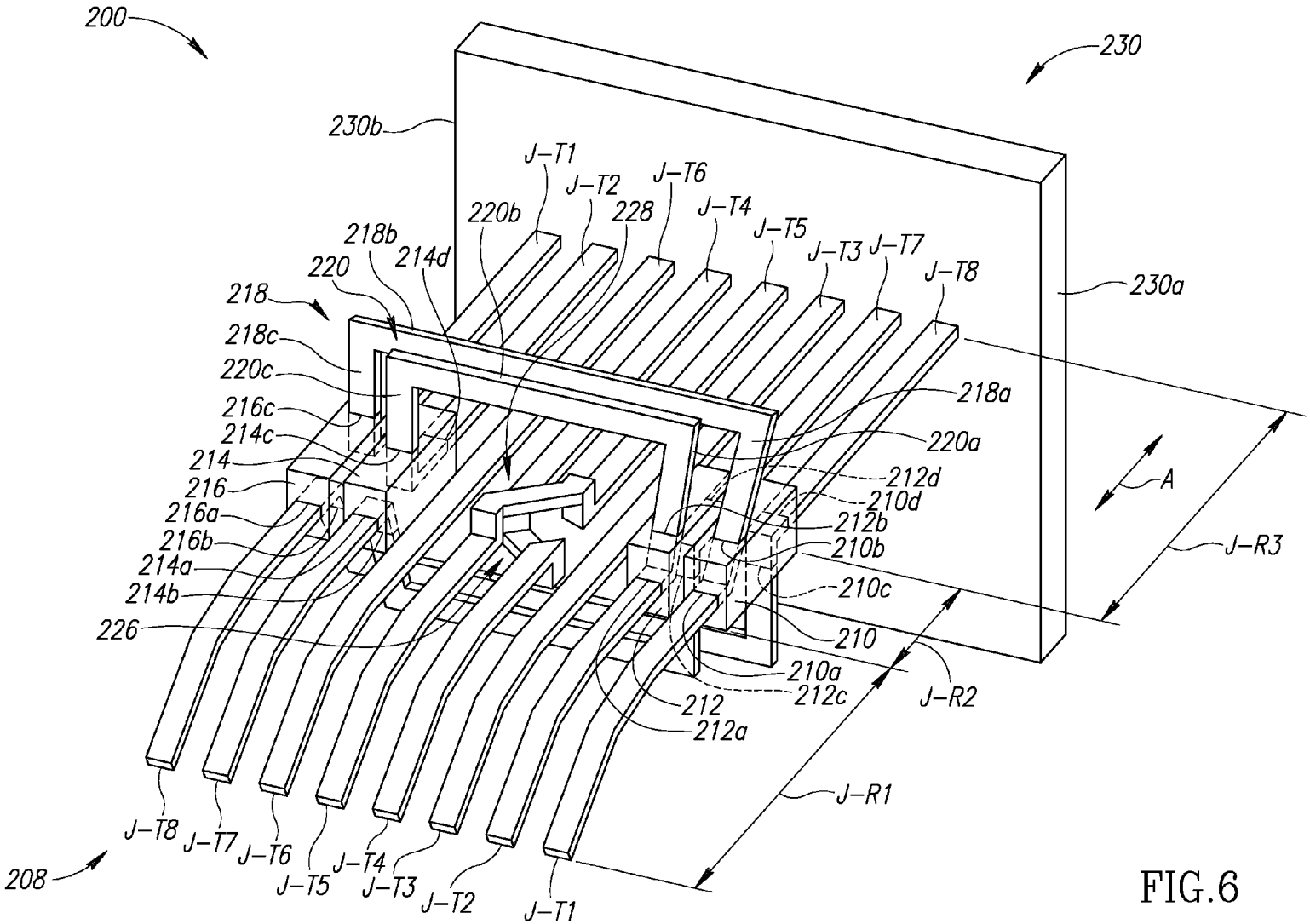
FIG. 6 is a perspective view of representative internal components of the communication jack of FIG. 5.
Figure 8:
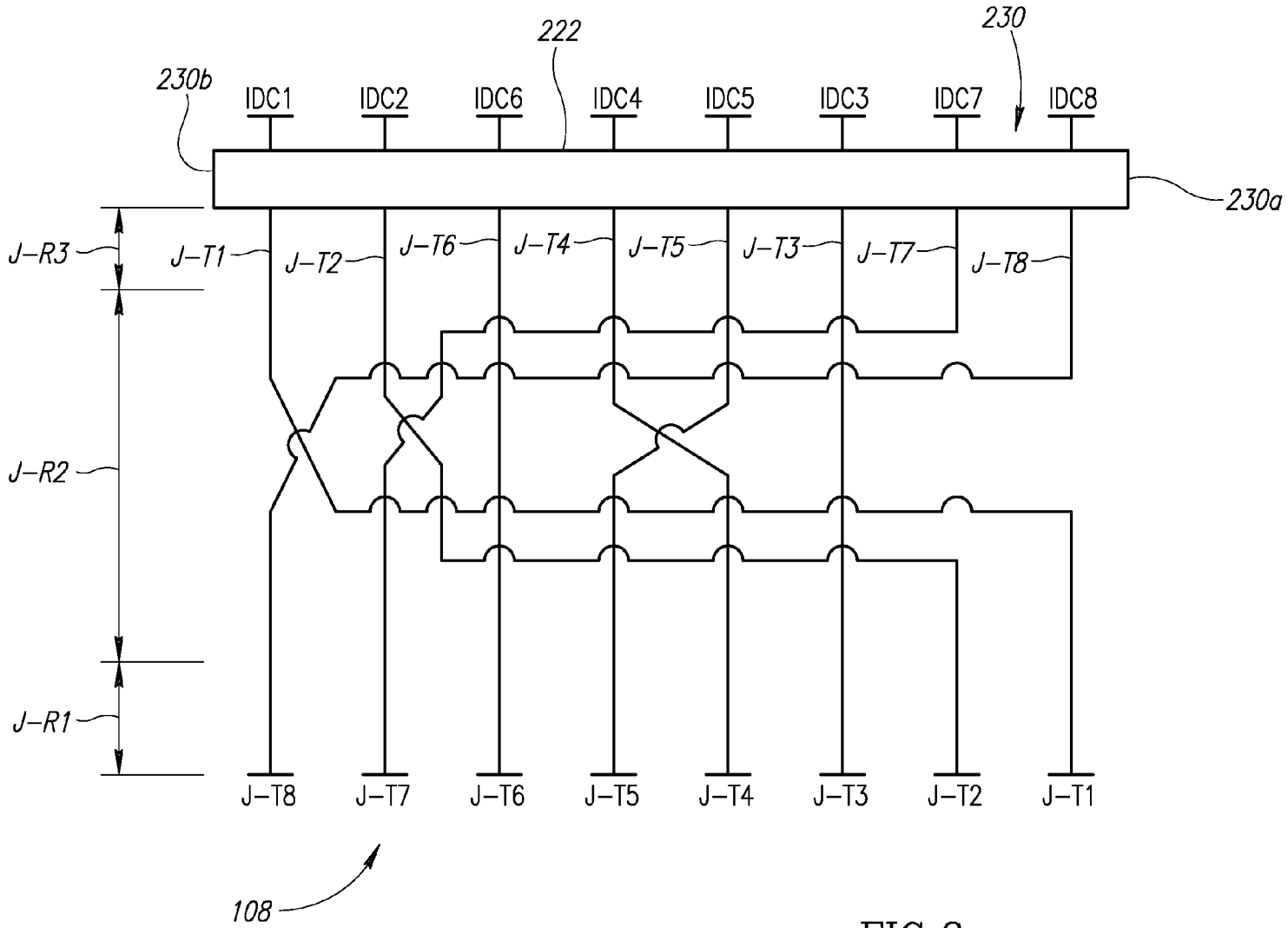
FIG. 8 is a schematic circuit diagram of internal components of the communication jack of FIG. 5.

The jack tines J-T1 to J-T8 are shown in simplified form for illustration purposes in FIG. 6 and in circuit form in FIG. 8 to include a first region J-R1, a second region J-R2, and a third region J-R3. The first region J-R1, is generally where engagement of the jack tines J-T1 to J-T8 occurs with the contacts of a connected communication plug (e.g., the plug contacts P-T1 to P-T8 of the communication plug 100). The second region J-R2, includes cross-member tine portions involved with lateral exchange of longitudinal routing of the second pair of jack tines J-T1 and J-T2 and the fourth pair of jack tines J-T7 and J-T8 as described further below. The third region J-R3 includes the second pair of jack tines J-T1 and J-T2 and the fourth pair of jack tines J-T7 and J-T8 with their locations laterally exchanged with one another in the second region J-R2, relative to their orientation in the first region J-R1.

Within the first region J-R1 and the third region J-R3, the jack tines J-T1 to J-T8 are substantially parallel with one another along an axis illustrated by a double-headed arrow "A." Within the second region J-R2, only the jack tines J-T6 and J-T3 are substantially parallel with one another along the axis illustrated by the double-headed arrow "A" as depicted in FIG. 6. The jack tines J-T1, J-T2, J-T4, J-T5, J-T7 and J-T8 each cross over at least one other jack tine in the second region J-R2. Thus, each of the jack tines J-T1, J-T2, J-T4, J-T5, J-T7 and J-T8 has a portion that extends laterally above or below at least one other jack tine, and crosses the at least one other jack tine, without electrically contacting it relative to the axis illustrated by the double-headed arrow "A."

The jack tines J-T1 to J-T8 extend from the second region J-R2, into the third region J-R3, where they engage with a substrate 230 (see FIG. 8), such as a printed circuit board, a "boardless" lead frame, or other support structure that has a first side 230*a* opposite a second side 230*b*. The substrate 230 connects the jack tines J-T1 to J-T8 with the insulated displacement connectors IDC1-IDC8, respectively, as shown in FIG. 8.

Included in the second region J-R2, further shown in FIG. 6, is a first insulative member 210 with a first aperture 210*a*, a second aperture 210*b*, a third aperture 210*c*, and a fourth aperture 210*d*; a second insulative member 212 with a first aperture 212*a*, a second aperture 212*b*, a third aperture 212*c*, and a fourth aperture 212*d*; a third insulative member 214 with a first aperture 214*a*, a second aperture 214*b*, a third aperture 214*c*, and a fourth aperture 214*d*; and a fourth insulative member 216 with a first aperture 216*a*, a second aperture 216*b*, a third aperture 216*c*, and a fourth aperture 216*d*. Each of the insulative members 210, 212, 214, and 216 is configured to support two of the jack tines J-T1, J-T2, J-T4, J-T5, J-T7 and J-T8 and direct the tine across at least one of the jack tines J-T1 to J-T8.

Figure 7:
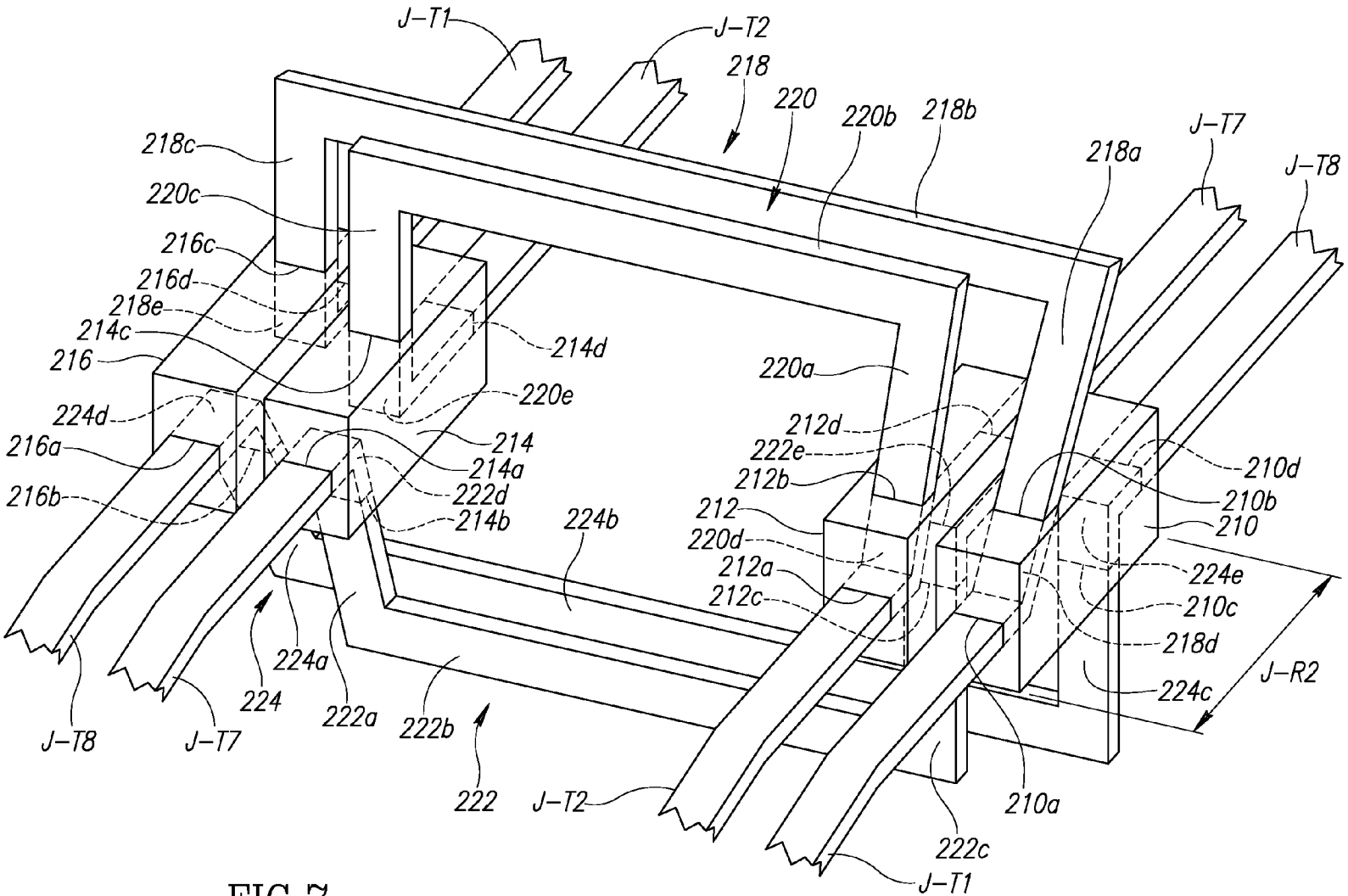
FIG. 7 is an enlarged fragmentary perspective view of the internal components of the communication jack of FIG. 6.

In FIG. 7, for illustrative purposes, jack tines J-T3, J-T4, J-T5, and J-T6 have been removed. In the second region J-R2, the jack tine J-T1 includes a first cross-member 218 with a first portion 218*a*, a second portion 218*b*, and a third portion 218*c*. The first aperture 210*a* of the first insulative member 210 is configured to receive the jack tine J-T1 from the first region J-R1. The first insulative member 210 directs the first portion 218*a* of the jack tine J-T1 out the second aperture 210*b*. A portion 218*d* of the jack tine J-T1 inside the first insulative member 210 is bent to position the second portion 218*b* above the jack tines J-T2, J-T3, J-T4, J-T5, J-T6, and J-T7 for the purposes of crossing thereover. The bent portion 218*d* may define an inside obtuse angle. Alternatively, the bent portion 218*d* may define an inside acute or right angle. It should be understood that the bent portion 218*d* of the jack tine J-T1 could be best to position the first portion 218*b* below the jack tines J-T2, J-T3, J-T4, J-T5, J-T6, and J-T7.

The first portion 218*a* is connected to or integrally formed with the second portion 218*b* that crosses over the jack tines J-T2, J-T3, J-T4, J-T5, J-T6, and J-T7. The second portion 218*b* is connected to or integrally formed with the third portion 218*c* that is received inside the third aperture 216*c* of the fourth insulative member 216. A portion 218*e* of the jack tine J-T1 inside the fourth insulative member 216 is bent to position the jack tine J-T1 to exit the fourth insulative member 216 through the fourth aperture 216*d* in an orientation that renders the jack tine J-T1 substantially parallel to the other jack tines J-T2 to J-T8 in the third region J-R3. The bent portion 218*e* may define an inside acute or right angle. Alternatively, the bent portion 218*e* may define an inside obtuse or right angle.

Thus, from the first region J-R1, the jack tine J-T1 enters the first insulative member 210 through the first aperture 210*a*, passes through the second aperture 210*b*, laterally crosses over jack tines J-T2 to J-T7 from a position nearer the first side 230*a* to a position nearer the second side 230*b* as the second portion 218*b* of the first cross member, goes through the third aperture 216*c* of the fourth insulative member 216 and goes into the third region J-R3 from the fourth aperture 216*d* of the fourth insulative support.

In the second region J-R2, the jack tine J-T2 includes a second cross-member 220 with a first portion 220*a*, a second portion 220*b*, and a third portion 220*c*. The first aperture 212*a* of the second insulative member 212 is configured to receive the jack tine J-T2 from the first region J-R1. The second insulative member 212 directs the first portion 220*a* of the jack tine J-T2 out the second aperture 212*b*. A bent portion 220*d* of the jack tine J-T2 inside the second insulative member 212 is bent to position the second portion 220*b* above the jack tines J-T3, J-T4, J-T5, and J-T6 for the purposes of crossing thereover. The bent portion 220*d* may define an inside obtuse angle. Alternatively, the bent portion 220*d* may define an inside acute or right angle. It should be noted that the bent portion 220*d* of the jack tine J-T2 could be bent to position the second portion 220*b* below the jack tines J-T3, J-T4, J-T5, and J-T6.

The first portion 220*a* is connected to or integrally formed with the second portion 220*b* that crosses over the jack tines J-T3, J-T4, J-T5, and J-T6. The second portion 220*b* is connected to or integrally formed with the third portion 220*c* that is received inside the third aperture 214*c* of the third insulative member 214. A bent portion 220*e* of the jack tine J-T2 inside the third insulative member 214 is bent to position the jack tine J-T2 to exit the third insulative member 214 through the fourth aperture 214*d* in an orientation that renders the jack tine J-T2 substantially parallel to the other jack tines J-T1 and J-T3 to J-T8 in the third region J-R3. The bent portion 220*e* may define an inside acute or right angle. Alternatively, the bent portion 220*e* may define an inside obtuse or right angle.

Thus, from the first region J-R1, the jack tine J-T2 enters the second insulative member 212 through the first aperture 212*a*, passes through the second aperture 212*b*, laterally crosses over jack tines J-T3 to J-T6 from a position nearer the first side 230*a* to a position nearer the second side 230*b* as the second portion 220*b* of the second cross member, goes through the third aperture 214*c* of the third insulative member 214 and goes into the third region J-R3 from the fourth aperture 214*d* of the third insulative support.

In the second region J-R2, the jack tine J-T7 includes a third cross-member 222 with a first portion 222*a*, a second portion 222*b*, and a third portion 222*c*. The first aperture 214*a* of the third insulative member 214 is configured to receive the jack tine J-T7 from the first region J-R1. The third insulative member 214 directs the first portion 222*a* of the jack tine J-T7 out the second aperture 214*b*. A bent portion 222*d* of the jack tine J-T7 inside the third insulative member 214 is bent to position the second portion 222*b* below the jack tines J-T3, J-T4, J-T5, and J-T6 for the purposes of crossing thereunder. The bent portion 222*d* may define an inside obtuse angle. Alternatively, the bent portion 222*d* may define an inside acute or right angle. It should be understood that the bent portion 222*d* of the jack tine J-T7 could be bent to position the second portion 222*b* above the jack tines J-T3, J-T4, J-T5, and J-T6.

The first portion 222*a* is connected to or integrally formed with the second portion 222*b* that crosses under the jack tines J-T3, J-T4, J-T5, and J-T6. The second portion 222*b* is connected to or integrally formed with the third portion 222*c* that is received inside the third aperture 212*c* of the second insulative member 212. A bent portion 222*e* of the jack tine J-T7 inside the second insulative member 212 is bent to position the jack tine J-T7 to exit the second insulative member 212 through the fourth aperture 212*d* in an orientation that renders the jack tine J-T7 substantially parallel to the other jack tines J-T1 to J-T6 and J-T8 in the third region J-R3. The bent portion 222*e* may define an inside acute or right angle. Alternatively, the bent portion 222*e* may define an inside obtuse or right angle.

Thus, from the first region J-R1, the jack tine J-T7 enters the third insulative member 214 through the first aperture 214*a*, passes through the second aperture 214*b*, laterally crosses under jack tines J-T3 to J-T6 from a position nearer the second side 230*b* to a position nearer the first side 230*a* as the second portion 222*b* of the third cross member, goes through the third aperture 212*c* of the second insulative member 212 and goes into the third region J-R3 from the fourth aperture 212*d* of the second insulative support.

In the second region J-R2, the jack tine J-T8 includes a fourth cross-member 224 with a first portion 224*a*, a second portion 224*b*, and a third portion 224*c*. The first aperture 216*a* of the fourth insulative member 216 is configured to receive the jack tine J-T8 from the first region J-R1. The fourth insulative member 216 directs the first portion 224*a* of the jack tine J-T8 out the second aperture 216*b*. A bent portion 224*d* of the jack tine J-T8 inside the fourth insulative member 216 is bent to position the second portion 224*b* below the jack tines J-T2, J-T3, J-T4, J-T5, J-T6, and J-T7 for the purposes of crossing thereunder. The bent portion 224*d* may define an inside obtuse angle. Alternatively, the bent portion 224*d* may define an inside acute or right angle. It should be understood that the bent portion 224*d* of the jack tine J-T8 could be bent to position the second portion 224*b* above the jack tines J-T2, J-T3, J-T4, J-T5, J-T6, and J-T7.

The first portion 224*a* is connected to or integrally formed with the second portion 224*b* that crosses under the jack tines J-T2, J-T3, J-T4, J-T5, J-T6, and J-T7. The second portion 224*b* is connected to or integrally formed with the third portion 224*c* that is received inside the third aperture 210*c* of the first insulative member 210. A bent portion 224*e* of the jack tine J-T8 inside first insulative member 210 is bent to position the jack tine J-T8 to exit the first insulative member 210 through the fourth aperture 210*d* in an orientation that renders the jack tine J-T8 substantially parallel to the other jack tines J-T1 to J-T7 in the third region J-R3. The bent portion 224*e* may define an inside acute or right angle. Alternatively, the bent portion 224*e* may define an inside obtuse or right angle.

Thus, from the first region J-R1, the jack tine J-T8 enters the fourth insulative member 216 through the first aperture 216*a*, passes through the second aperture 216*b*, laterally crosses under jack tines J-T2 to J-T7 from a position nearer the second side 230*b* to a position nearer the first side 230*a* as the second portion 224*b* of the fourth cross member, goes through the third aperture 210*c* of the first insulative member 210 and goes into the third region J-R3 from the fourth aperture 210*d* of the first insulative support.

Returning to FIG. 6, the jack tine J-T4 has a cross-over portion 226 and the jack tine J-T5 has a cross-over portion 228. The cross-over portion 226 of the jack tine J-T4 crosses under the cross-over portion 228 of the jack tine J-T5. In the embodiment illustrated, the cross-over portions 226 and 228 are located approximately between the second portions 218*b* and 220*b* of the jack tines J-T1 and J-T2, and the second portions 222*b* and 224*b* of the jack tines J-T7 and J-T8.

In a communication jack (such as the communication jack 200), the crosstalk coupling zone may extend along the length of the jack tines J-T1 to J-T8 (i.e., across regions J-R1, J-R2, and J-R3). As mentioned above in the Background Section, in a conventional communication jack, crosstalk may be reduced by crossing the jack tines J-T3 and J-T6 (or conductors connected thereto) of the split third jack tine pair relative to the first and second paired conductors PC-P1 and PC-P2.

In contrast, in the communication jack 200, capacitive and/or inductive coupling between the jack tines J-T3 and J-T6 of the split third jack tine pair 3 and the second and fourth jack tine pairs 2 and 4 is avoided by crossing the jack tine pair 2 and the fourth jack tine pair 4 (instead of the jack tines J-T3 and J-T6 or conductors connected thereto). In this arrangement, any charge present in the jack tine J-T3 may possibly couple with a first portion of the jack tine pair 2 in the first region J-R1 and any charge present in the jack tine J-T6 may possibly couple with a first portion of the fourth jack tine pair 4 in the first region J-R1. The first portion of the second jack tine pair 2 is spaced apart from, and juxtaposed with, the first portion of the fourth jack tine pair 4 in the first region J-R1. Further, any charge present in the jack tine J-T3 may possibly couple with a second portion of the fourth jack tine pair 4 in the third region J-R3 and any charge present in the jack tine J-T6 may possibly couple with a second portion of the second jack tine pair 2 in the third region J-R3. The second portion of the second jack tine pair 2 is spaced apart from and juxtaposed with the second portion of the fourth jack tine pair 4 in the third region J-R3.

The first portion of the second jack tine pair 2 and the second portion of the fourth jack tine pair 4 are both adjacent to different sections of the jack tine J-T3, which negates or cancels any capacitive coupling between the jack tine J-T3 and the second and fourth jack tine pairs 2 and 4. Similarly, the second portion of the second jack tine pair 2 and the first portion of the fourth jack tine pair 4 are both adjacent to different sections of the jack tine J-T6, which negates or cancels any capacitive coupling between the jack tine J-T6 and the second and fourth jack tine pairs 2 and 4. Further, the direction of the magnetic field formed between the first portions of the second and fourth jack tine pairs 2 and 4 is the opposite that of the magnetic field formed between the second portions of the second and fourth jack tine pairs 2 and 4, which negates or cancels the inductive coupling between the jack tines J-T3 and J-T6 and the second and fourth jack tine pairs 2 and 4. In other words, in the communication jack 200, mode conversion coupling is reduced by removing or subtracting away an equal amount of adverse coupling from each of the second and fourth jack tine pairs 2 and 4.

Mode conversion coupling may also be reduced by crossing the jack tines J-T4 and J-T5, both of which are located between the second and fourth jack tine pairs 2 and 4 and could potentially couple therewith if the jack tines J-T4 and J-T5 are not crossed. Crossing the jack tines J-T4 and J-T5 could also help prevent coupling between the jack tines J-T4 and J-T5 and the jack tines J-T3 and J-T6, respectively.

As is apparent to those of ordinary skill in the art, mode conversion coupling may be reduced or eliminated in a communication connector formed by connecting the communication plug 100 with the communication jack 200, any communication jack known in the art including the conventional communication jack described in the Background Section, and the like. Further, mode conversion coupling may be reduced or eliminated in a communication connector formed by connecting the communication plug 100 with a communication jack in which none of the wires are crossed for the purposes of reducing or eliminating mode conversion coupling.

Further, mode conversion coupling may be reduced or eliminated in a communication connector formed by connecting the communication jack 200 with the communication plug 100, any communication plug known in the art including the conventional communication plug described in the Background Section, and the like. Further, mode conversion coupling may be reduced or eliminated in a communication connector formed by connecting the communication jack 200 with a communication plug in which none of the wires are crossed for the purposes of reducing or eliminating mode conversion coupling.

As is appreciated by those of ordinary skill in the art, it may be desirable to preserve a proper amount of pair-to-pair (internal) differential crosstalk inside the plug that would otherwise occur without the inclusion of the modal cancellation/compensation described above. Thus, in some implementations, adjustment of wire position details may be necessary to maintain all six combinations of differential crosstalk in the 4-pair example of the plug. Further, as is appreciated by those of ordinary skill in the art, many techniques are known for reducing crosstalk within a communication connector. Through application of ordinary skill in the art to the present teachings, communication jacks, plugs, and connectors may be constructed that include implementations of such techniques and such devices are within the scope of the present teachings.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A communication connector comprising:

a communication jack;

a plug body shaped to mate with the communication jack, the plug body having a contact region with a plurality of plug contacts including a first contact, P-T1, a second contact, P-T2, a third contact, P-T3, a fourth contact, P-T4, a fifth contact, P-T5, a sixth contact, P-T6, a seventh contact, P-T7, and an eighth contact, P-T8, being located in juxtaposition in numerical order, the first contact, P-T1, positioned closest to a first side of the plug body, and the eighth contact, P-T8, positioned closest to a second side of the plug body opposite the first side, the plug body including a cross-over region positioned away from the plurality of plug contacts; and a communication cable including a first twisted pair having two wires, a second twisted pair having two wires, a third twisted pair having two wires, and a fourth twisted pair having two wires, one of the two wires of the second twisted pair being connected to the first contact, P-T1, and the other of the two wires of the second twisted pair being connected to the second contact, P-T2, one of the two wires of the fourth twisted pair being connected to the seventh contact, P-T7, and the other of the two wires of the fourth twisted pair being connected to the eighth contact, P-T8, the second twisted pair and the fourth twisted pair extending from the contact region and crossing the other in the cross-over region, the two wires of the second twisted pair being twisted together in the cross-over region and extending from the cross-over region in a direction away from the contact region at a location adjacent a portion of the second side, and the two wires of the fourth twisted pair being twisted together in the cross-over region and extending from the cross-over region in a direction away from the contact region at a location adjacent a portion of the first side.

2. The communication connector of claim 1, wherein the communication jack comprises:

a plurality of jack contacts including a first contact, J-T1, a second contact, J-T2, a third contact, J-T3, a fourth contact, J-T4, a fifth contact, J-T5, a sixth contact, J-T6, a seventh contact, J-T7, and an eighth contact, J-T8, each of the jack contacts including a first portion located in a first jack region, a second portion located in a second jack region and a third portion located in a third jack region, the second portions extending between their respective first and third portions, the first and third jack regions being spaced apart with the second jack region being positioned therebetween, the first portion of the first contact, J-T1, the second contact, J-T2, the third contact, J-T3, the fourth contact, J-T4, the fifth contact, J-T5, the sixth contact, J-T6, the seventh contact, J-T7, and the eighth contact, J-T8, being positioned for engagement with the first contact, P-T1, the second contact, P-T2, the third contact, P-T3, the fourth contact, P-T4, the fifth contact, P-T5, the sixth contact, P-T6, the seventh contact, P-T7, and the eighth contact, P-T8, respectively, of the communication plug, the first portions being located within the first jack region in juxtaposition in numerical order, the first portion of the first contact, J-T1, positioned closest to the first side of the plug body and the first portion of the eighth contact, J-T8, positioned closest to the second side of the plug body when the plug body is mated with the communication jack, and the third portion of the first contact, J-T1, positioned closest to the second side of the communication jack and the third portion of the eighth contact, J-T8, positioned closest to the first side of the communication jack when the plug body is mated with the communication jack.

3. The communication connector of claim 2, further comprising a first insulative member and a second insulative member located in the second jack region, the first and second insulative members being laterally spaced apart with the first insulative member positioned closest to the first side of the plug body and the second insulative member positioned closest to the second side of the plug body when the plug body is mated with the communication jack, the second portion of the first contact, J-T1, and the second portion of the eighth contact, J-T8, are each supported in the second jack region by both the first and second insulative members and each extends therebetween.

4. The communication connector of claim 3, wherein in the second jack region, the first contact, J-T1, extends between the first insulative member and the second insulative member on a first side of the third contact, J-T3, the fourth contact, J-T4, the fifth contact, J-T5, and the sixth contact, J-T6, and the eighth contact, J-T8, extends between the first insulative member and the second insulative member on an opposite second side of the third contact, J-T3, the fourth contact, J-T4, the fifth contact, J-T5, and the sixth contact, J-T6.

5. The communication connector of claim 2, wherein in the second jack region, the second portion of the first contact, J-T1, extends substantially laterally crossing on one side of the third contact, J-T3, the fourth contact, J-T4, the fifth contact, J-T5, and the sixth contact, J-T6, and the second portion of the eighth contact, J-T8, extends substantially laterally crossing on an opposite side of the third contact, J-T3, the fourth contact, J-T4, the fifth contact, J-T5, and the sixth contact, J-T6.

6. The communication connector of claim 2, wherein in the third jack region the third portion of the fourth contact, J-T4, is positioned between the third portion of the fifth contact, J-T5, and the third portion of the sixth contact, J-T6.

7. The communication connector of claim 2, wherein in the third jack region, the third portion of the seventh contact, J-T7, extends in juxtaposition with the third portion of the eighth contact, J-T8, and the third portion of the second contact, J-T2, extends in juxtaposition with the third portion of the first contact, J-T1.

8. The communication connector of claim 1 wherein portions of the two wires of the third twisted pair straddle the first twisted pair, one of the two wires of the third twisted pair being connected to the third contact, P-T3, and the other of the two wires of the third twisted pair being connected to the sixth contact, P-T6.

9. A communication connector comprising:

a communication plug having a plurality of plug contacts; and a communication jack for engagement with the communication plug, the communication jack comprising:

a plurality of wire termination contacts;

a main housing having a frame with an aperture shaped to receive the communication plug, the main housing having a first longitudinal side and a second longitudinal side, the first longitudinal side being opposite the second longitudinal side; and a plurality of jack contacts enclosed by the main housing, and accessible to the communication plug through the aperture, the plurality of jack contacts including a first contact, J-T1, a second contact, J-T2, a third contact, J-T3, a fourth contact, J-T4, a fifth contact, J-T5, a sixth contact, J-T6, a seventh contact, J-T7, and an eighth contact, J-T8, each of the jack contacts including a longitudinally extending first portion located in a first jack region nearest the aperture, a second portion located in a second jack region and a longitudinally extending third portion located in a third jack region, the first and third jack regions being spaced apart with the second jack region being positioned therebetween, the first portions of the first contact, J-T1, the second contact, J-T2, the third contact, J-T3, the fourth contact, J-T4, the fifth contact, J-T5, the sixth contact, J-T6, the seventh contact, J-T7, and the eighth contact, J-T8, being positioned in the first jack region to connect with a corresponding one of the plurality of plug contacts when the communications jack is engaged with the communications plug, the first portions being located within the first jack region in juxtaposition in numerical order, the first portion of the first contact, J-T1, positioned closest to the first longitudinal side of the main housing and the first portion of the eighth contact, J-T8, positioned closest to the second longitudinal side of the main housing, and the third portions of the first contact, J-T1, the second contact, J-T2, the third contact, J-T3, the fourth contact, J-T4, the fifth contact, J-T5, the sixth contact, J-T6, the seventh contact, J-T7, and the eighth contact, J-T8, being connected to the wire termination contacts, the third portion of the first contact, J-T1, positioned closest to the second longitudinal side of the main housing and the third portion of the eighth contact, J-T8, positioned closest to the first longitudinal side of the main housing.

10. The communication connector of claim 9, wherein the plurality of plug contacts comprises:

a first plug contact, P-T1, located in a contact region of the communication plug, connectable to the first contact, J-T1, when the communication jack is engaged with the communication plug, a second plug contact, P-T2, located in the contact region, connectable to the second contact, J-T2, when the communication jack is engaged with the communication plug, a third contact, P-T3, located in the contact region, connectable to the third contact, J-T3, when the communication jack is engaged with the communication plug, a fourth contact, P-T4, located in the contact region, connectable to the fourth contact, J-T4, when the communication jack is engaged with the communication plug, a fifth contact, P-T5, located in the contact region, connectable to the fifth contact, J-T5, when the communication jack is engaged with the communication plug, a sixth contact, P-T6, located in the contact region, connectable to the sixth contact, J-T6, when the communication jack is engaged with the communication plug, a seventh contact, P-T7, located in the contact region, connectable to the seventh contact, J-T7, when the communication jack is engaged with the communication plug, and an eighth contact, P-T8, located in the contact region, connectable to the eighth contact, J-T8, when the communication jack is engaged with the communication plug, and the communication plug further comprises:

a first side adjacent the first longitudinal side of the main housing, and a second side adjacent the second longitudinal side of the main housing when the communication jack is engaged with the communication plug; and a communication cable including a first twisted pair having two wires, a second twisted pair having two wires, a third twisted pair having two wires, and a fourth twisted pair having two wires, one of the two wires of the second twisted pair being connected to the first contact, P-T1, and extending in the contact region along a portion of the first side of the communication plug, and the other of the two wires of the second twisted pair being connected to the second contact, P-T2, one of the two wires of the fourth twisted pair being connected to the seventh contact, P-T7, and the other of the two wires of the fourth twisted pair being connected to the eighth contact, P-T8, and extending in the contact region along a portion of the second side of the communication plug, the second twisted pair and the fourth twisted pair extending from their respective ones of the plurality of plug contacts to which the second and fourth twisted pairs are connected through a cross-over region of the communication plug wherein the second and fourth twisted pairs cross each other at a location spaced away from the plurality of plug contacts, the two wires of the second twisted pair being twisted together in the cross-over region and extending away from the cross-over region in a direction away from the contact region at a location adjacent a portion of the second side of the communication plug, and the two wires of the fourth twisted pair being twisted together in the cross-over region and extending away from the cross-over region in a direction away from the contact region at a location adjacent a portion of the first side of the communication plug.

11. A communication plug comprising:

a plug body having a first side and a second side, the plug body including a contact region with a plurality of contacts in juxtaposition along a row extending between a first contact closest to the first side and a last contact closest to the second side, and a cross-over region; and a communication cable including a plurality of twisted pairs each having two wires, one of the twisted pairs connected to a pair of the plurality of contacts and extending away from the contacts to which the one of the twisted pairs is connected along a path having a first portion extending therealong closer to the first side than the second side, a second portion extending through the cross-over region and transitioning from a position closer to the first side to a position closer to the second side, and a third portion extending therealong closer to the second side than the first side, and another of the twisted pairs connected to another pair of the plurality of contacts and extending away from the contacts to which the another twisted pair is connected along a path having a first portion extending therealong closer to the second side than the first side, a second portion extending through the cross-over region and transitioning from a position closer to the second side to a position closer to the first side, and a third portion extending therealong closer to the first side than the second side, the two wires of the one twisted pair being twisted together as they extend through the cross-over region and the two wires of the another twisted pair being twisted together as they extend through the cross-over region.

12. A communication plug comprising:

a plug body including a plurality of contacts in juxtaposition along a row; and a communication cable including a plurality of twisted pairs each having two wires, one of the twisted pairs connected to a pair of adjacent contacts of the plurality of contacts and extending away therefrom through a cross-over region and another one of the twisted pairs connected to another pair of adjacent contacts of the plurality of contacts and extending away therefrom through the cross-over region, the two twisted pairs overlapping in the cross-over region, others of the plurality of contacts being positioned between the pair of adjacent contacts to which the one twisted pair is connected and another pair of adjacent contacts to which the another twisted pair is connected.

13. The communication plug of claim 12 wherein the two wires of the one twisted pair are twisted together for a plurality of twists as they extend through the cross-over region and the two wires of the another twisted pair are twisted together for a plurality of twists as they extend through the cross-over region.

14. The communication plug of claim 12 wherein the cross-over region is within the plug body.

15. The communication plug of claim 12 wherein the two wires of a further one of the plurality of twisted pairs are separated from being twisted together in the cross-over region.

16. The communication plug of claim 15 wherein the two wires of the further one of the plurality of twisted pairs in the cross-over region straddle either side of an additional one of the plurality of twisted pairs.

17. A communication jack comprising:

a support substrate having a first lateral side and a second lateral side; and a plurality of contact pairs including a first contact pair, a second contact pair, a third contact pair, and a fourth contact pair, the first, second and fourth contact pairs each having an adjacently positioned set of two contacts, and the third contact pair having a set of two contacts with the first contact pair being positioned between the two contacts of the third contact pair, each contact pair including a first portion located in a first region, a second portion located in a second region and a third portion located in a third region, with the second region positioned between the first and third regions, the first portion longitudinally extending toward the support substrate, the third portion connected to the support substrate, and the second portion extending between the first portion and the third portion, the first portion of the second contact pair laterally positioned toward the first lateral side of the support substrate and the first portion of the fourth contact pair laterally positioned toward the second lateral side of the support substrate with the first portions of the first and third contact pairs positioned between the first portions of the second and fourth contact pairs, and the third portion of the second contact pair laterally positioned toward the second lateral side of the support substrate and the third portion of the fourth contact pair laterally positioned toward the first lateral side of the support substrate with the third portions of the first and third contact pairs positioned between the third portions of the second and fourth contact pairs.

18. The communication jack of claim 17, further including a first insulative member, a second insulative member, a third insulative member, and a fourth insulative member located in the second region, one of the contacts of the second portion of the second contact pair is supported in the second region by the first and fourth insulative members and extends therebetween, and the other of the contacts of the second portion of the second contact pair is supported in the second region by the second and third insulative members and extends therebetween, and one of the contacts of the second portion of the fourth contact pair is supported in the second region by the first and fourth insulative members and extends therebetween, and the other of the contacts of the second portion of the fourth contact pair is supported in the second region by the second and third insulative members and extends therebetween.

19. The communication jack of claim 18, wherein in the second region, the second contact pair extends between the first and second insulative members and the third and fourth insulative members on a first side of a portion of the first and third contact pairs, and the fourth contact pair extends between the first and second insulative members and the third and fourth insulative members on an opposite second side of the first and third contact pairs.

20. The communication jack of claim 17 wherein in the second region the second portion of the second contact pair and the second portion of the fourth contact pair cross over each other.

21. The communication jack of claim 17 wherein in the second region, the second portion of the second contact pair extends substantially laterally on one side of the second portions of the first and third contact pairs, and the second portion of the fourth contact pair extends substantially laterally on an opposite side of the second portions of the first and third contact pairs.

22. A communication jack for connecting to a communication plug, the communication jack comprising:

a plurality of wire termination contacts;

a main housing having a frame with an aperture shaped to receive the communication plug, the main housing having a first longitudinal side and a second longitudinal side, the first longitudinal side being opposite the second longitudinal side; and a plurality of contact pairs including a first contact pair, a second contact pair, a third contact pair, and a fourth contact pair, the first, second and fourth contact pairs each having an adjacently positioned set of two contacts, and the third contact pair having a set of two contacts with the first contact pair being positioned between the two contacts of the third contact pair, the plurality of contact pairs being enclosed by the main housing and accessible through the aperture, each contact pair including a first portion located in a first region nearest the aperture, a second portion located in a second region and a third portion located in a third region nearest the wire termination contacts, with the second region positioned between the first and third regions, the first portion extending longitudinally from the aperture toward the wire termination contacts, the third portion extending longitudinally from the second portion to the wire termination contacts, and the second portion extending between the first portion and the third portion, the first portion of the second contact pair laterally positioned toward the first longitudinal side of the main housing and the first portion of the fourth contact pair laterally positioned toward the second longitudinal side of the main housing with the first portions of the first and third contact pairs positioned between the first portions of the second and fourth contact pairs, and the third portion of the second contact pair laterally positioned toward the second longitudinal side of the main housing and the third portion of the fourth contact pair laterally positioned toward the first longitudinal side of the main housing with the third portions of the first and third contact pairs positioned between the third portions of the second and fourth contact pairs.

23. The communication jack of claim 22, further including a first insulative member, a second insulative member, a third insulative member, and a fourth insulative member located in the second region, one of the contacts of the second portion of the second contact pair is supported in the second region by the first and fourth insulative members and extends therebetween, and the other of the contacts of the second portion of the second contact pair is supported in the second region by the second and third insulative members and extends therebetween, and one of the contacts of the second portion of the fourth contact pair is supported in the second region by the first and fourth insulative members and extends therebetween, and the other of the contacts of the second portion of the fourth contact pair is supported in the second region by the second and third insulative members and extends therebetween.

24. The communication jack of claim 23 wherein in the second region the second contact pair extends between the first and second insulative members and the third and fourth insulative members on a first side of a portion of the first and third contact pairs, and the fourth contact pair extends between the first and second insulative members and the third and fourth insulative members on an opposite second side of a portion of the first and third contacts.

25. The communication jack of claim 22 wherein in the second region the second portion of the second contact pair and the second portion of the fourth contact pair cross over each other.

26. The communication jack of claim 22 wherein in the second region the second portion of the second contact pair extends substantially laterally on one side of the second portion of the first and third contact pairs, and the second portion of the fourth contact pair extends substantially laterally on an opposite side of the second portion of the first and third contact pairs.

* * * * *